US009049754B2

(12) United States Patent
Goldsmith

(10) Patent No.: US 9,049,754 B2
(45) Date of Patent: Jun. 2, 2015

(54) SYSTEM AND METHOD FOR THE CONTROL OF A PLURALITY OF LASERS

(71) Applicant: Dan Goldsmith, Laurel, MD (US)

(72) Inventor: Dan Goldsmith, Laurel, MD (US)

(73) Assignee: X-LASER, LLC, Laurel, MD (US)

( * ) Notice: Subject to any disclaimer, the term of this patent is extended or adjusted under 35 U.S.C. 154(b) by 398 days.

(21) Appl. No.: 13/694,106

(22) Filed: Oct. 29, 2012

(65) Prior Publication Data

US 2013/0169192 A1 Jul. 4, 2013

Related U.S. Application Data

(60) Provisional application No. 61/628,315, filed on Oct. 28, 2011.

(51) Int. Cl.
*H05B 37/02* (2006.01)

(52) U.S. Cl.
CPC ..... *H05B 37/02* (2013.01); *H05B 37/0254* (2013.01); *H05B 37/029* (2013.01)

(58) Field of Classification Search
None
See application file for complete search history.

(56) References Cited

U.S. PATENT DOCUMENTS 5,065,330 A * 11/1991 Karube et al. ..... 700/166
6,507,760 B1 * 1/2003 Baumgartner ..... 700/2
8,049,135 B2 * 11/2011 Bruland et al. ..... 219/121.69

* cited by examiner

*Primary Examiner* — Lincoln Donovan
*Assistant Examiner* — Khareem E Almo
(74) *Attorney, Agent, or Firm* — Andrew C. Aitken

(57) ABSTRACT

A laser light display system that includes a plurality of laser heads, a router controller and a plurality of transmission cables is disclosed. The system includes control signal receivers associated with the laser heads and a laser controller that includes a relay, signal output ports, and a programmable logic controller for providing output signals for the control of the laser heads each which emit a single static and motionless beam of radiation of visible light.

13 Claims, 11 Drawing Sheets

SYSTEM AND METHOD FOR THE CONTROL OF A PLURALITY OF LASERS

The applicant claims the benefit of U.S. Application No. 61/628,315 filed on Oct. 28, 2011. The present invention is directed to a system and method for the control of a plurality of lasers. The invention includes a multi-purpose laser system that may be used in connection with laser shows that are provided in attractions, shows and nightclubs as well in architectural, television and film, and industrial applications. While the primary application is to produce an improved laser light show, the invention may also be used for industrial signaling, targeting, special effects and other applications.

BRIEF DESCRIPTION OF THE INVENTION

The system of the invention includes a central control device or router which may be preprogrammed with a control logic or may accepts control inputs from a variety of sources. The router processes the inputs and then distributes activation signals down cables to a plurality of laser "heads. The term "head" refers to a discrete fixture from which a laser radiation is emitted. In the system of the invention, one or more heads receive incoming activation signals from the central control device which activate an enclosed source of laser light as well as any other apparatus which may be included at the head to achieve a desired effect.

The router includes a programmable logic controller to enable it to fully control the activation of a plurality of heads. In an embodiment as further discussed below, the controller includes logic to sequentially activate each of the heads that are in communication with the controller and, when the last device has been activated to repeat the initiation of the sequence. Alternatively, control signals from a DMX controller may be received by the router to provide custom selected activation sequences or other activation control, such as control that is based upon a secondary input signal to the DMX controller such as a signal from a microphone.

BACKGROUND OF THE INVENTION

A popular visual effect that can be created using lasers is referred to colloquially as the "Star Wars" effect. This effect describes the sequential activation of lasers so that the beams of light are directed in multiple directions around a room or area creating dramatic effects in the air. This effect has been created by prior art devices by either the use of what is referred to as a beam table or by the use of scanning projectors.

Beam tables are large and bulky devices conventionally use a single powerful laser source inside a large enclosure. The beam tables are heavy and both costly to manufacture and to set up in particular location. In a conventional beam table, the beam is interrupted by rotary or linear actuators or stepper motor actuated mirrors. Each mirror interrupting the beam in sequence redirects the beam upward and out of the enclosure. Then, one or more secondary mirrors, or galvonometer scanner, directs the beam completely out of the assembly to some remote destination. While the device created a pleasing effect, the approach has a number of limitations.

A first problem associated with beam table systems is that they are prone to failure because of the numerous moving parts. Consequently, the devices required frequent service. A single beam table may use four to twelve sets of motor actuated mirrors, as well as multiple optics that have sensitive alignment requirements. Numerous other devices may also be used to achieve beam effects. These systems were expensive to manufacture, complicated to build and had limited control options. In addition, a beam table, a beam table system may have four to five optical surfaces per beam which may require both alignment and cleaning. Because a single laser is responsible for all of the effects, a failure of the laser would prevent the entire system from operating. Likewise, a failure of one of the devices that interrupt the beam may also adversely affect the performance of the entire system.

In addition, in a beam table laser device, the beams originate from a single location. Practically speaking, to substantially fill a room with beams of light, the beams must be reflected one or more times from secondary bounce mirrors located throughout a venue. For example, a beam table that has eight heads, or sometimes called turrets, can shoot eight beams from the device—but each beam would bounce one or more times dramatically extending the reach of the system. Alignments of these components were extremely time consuming, and dangerous, because it forced technicians to be located directly adjacent to the secondary bounce mirror during focusing. Further, the systems were prone to failure. One small shift in a mirror could move a beam many feet by the time the bounce ended. This created both a safety hazard and great setup difficulty.

In contrast with the beam table devices, the system described herein can place a discrete relatively inexpensive laser head in any location up to 200' from a router device allowing beams to originate anywhere within most indoor venues thereby eliminating the need for secondary bounce mirrors, alignments, and frequent cleaning. Also, beam angles are able to be adjusted easily and safely as the beam can be easily directed to shoot away from the technician and therefore there is not a concern where a particular reflection might end up.

Another problem with the beam table design systems was that these systems involved a single powerful laser beam originating at a diode and ending wherever the final bounce terminated. Each time a laser is reflected, passed through an optic or is interrupted, beam intensity is lost. This effect is further exacerbated by the great distance a beam had to travel through so many bounces because the cross section of the beam gets larger as it travels from its origin, further lowering the intensity of the effect. To compensate for these effects, beam tables traditionally used very high powered lasers which made them more dangerous to work around, more dangerous to focus and increased the hazard to the audience when a reflection went somewhere unexpected.

In contrast, the system of the invention requires zero bounces, can be shot in a straight line any distance and has only two small optics (one inside the laser diode and one external optic) to pass through to create the light beam.

A further disadvantage of beam table systems is that they are difficult to temporarily set up and are therefore not practical for mobile applications. In view of the time that is required to set up the complex system, including time required to place and focus the multiple bounce mirrors and in consideration the of the relative high cost of these systems, there use is for permanent installation such as nightclubs or commercial attractions. Because the costs and fees for the systems in both materials and labor is high, the implementation of these systems and the effect has been limited, notwithstanding the advantages and striking visual effect than can be achieved.

In view of the costs and problems with beam tables and relative acceptable and common use of scanning projectors in connection with laser displays, the scanning projectors have been used to approximate beam table effects or "star wars" laser effects. In an example, a projection scanner can use an electronic modulation of the beam instead of interrupting it with mirrors and then use two scanning mirrors to target the beams to specific X/Y coordinates.

These scanning systems are lighter, more portable, more affordable than beam tables. In addition, they are less prone to failure and have updated features that were not available when the beam was commonly used for the effect. However, scanning projections still have some disadvantage when used for this application.

Like beam tables, a scanning projector still only projects beams from a single source. To get the room filling effect one still would need to use either bounce mirrors or multiple scanning projectors devices. If the installation required bounce mirrors, many of the same problems discussed above are not ameliorated. While, the costs of scanning projectors which have complex control and optical surfaces are relatively high when compared to the laser head disclosed below.

In addition, scanning projectors have limited projection angles when compared to the laser head discussed which can be oriented in any direction on any plane. In this regard, conventional scanning projectors are limited typically to 30-50 degrees on both the X and Y axis from their center point. Scanners are also still prone to motor failure, are fragile since mirrors have to have minimal mass in order to move as quickly as required, and are limited by the resolution of their motors.

Scanning projectors also generally require specialized software to program them to hit certain, specific predetermined points. As such, scanners projectors require additional equipment, additional expense and specialized personnel to program the system. Finally, beams emitted from scanning projectors are often very thin and not nearly as visible as the big thick beams used in the desired effect. The beams from these devices typically have to be quite small due to the relatively small surface area of the galvanometer mirrors. If the beam is too big it spills over the edges of the mirrors causing power loss and ghosting effects. If the beam is compatible with the mirror, it is often less dramatic and visible to the audience.

Building a system using multiple scanning projectors to achieve the effect would be considerably extremely expensive and creates a special safety hazard because if the scanners were to fail when the projector was placed at a desired angle, a relative high powered beam might be accidently directed into an audience area. The prevention of this situation must therefore be addressed which would require significant cost, time and expertise. Even then, a conventional full scanning projectors is large, relatively heavy, expense device and therefore cannot be easily concealed in scenery or an architectural feature.

DETAILED DESCRIPTION OF EMBODIMENTS

Figure 1:
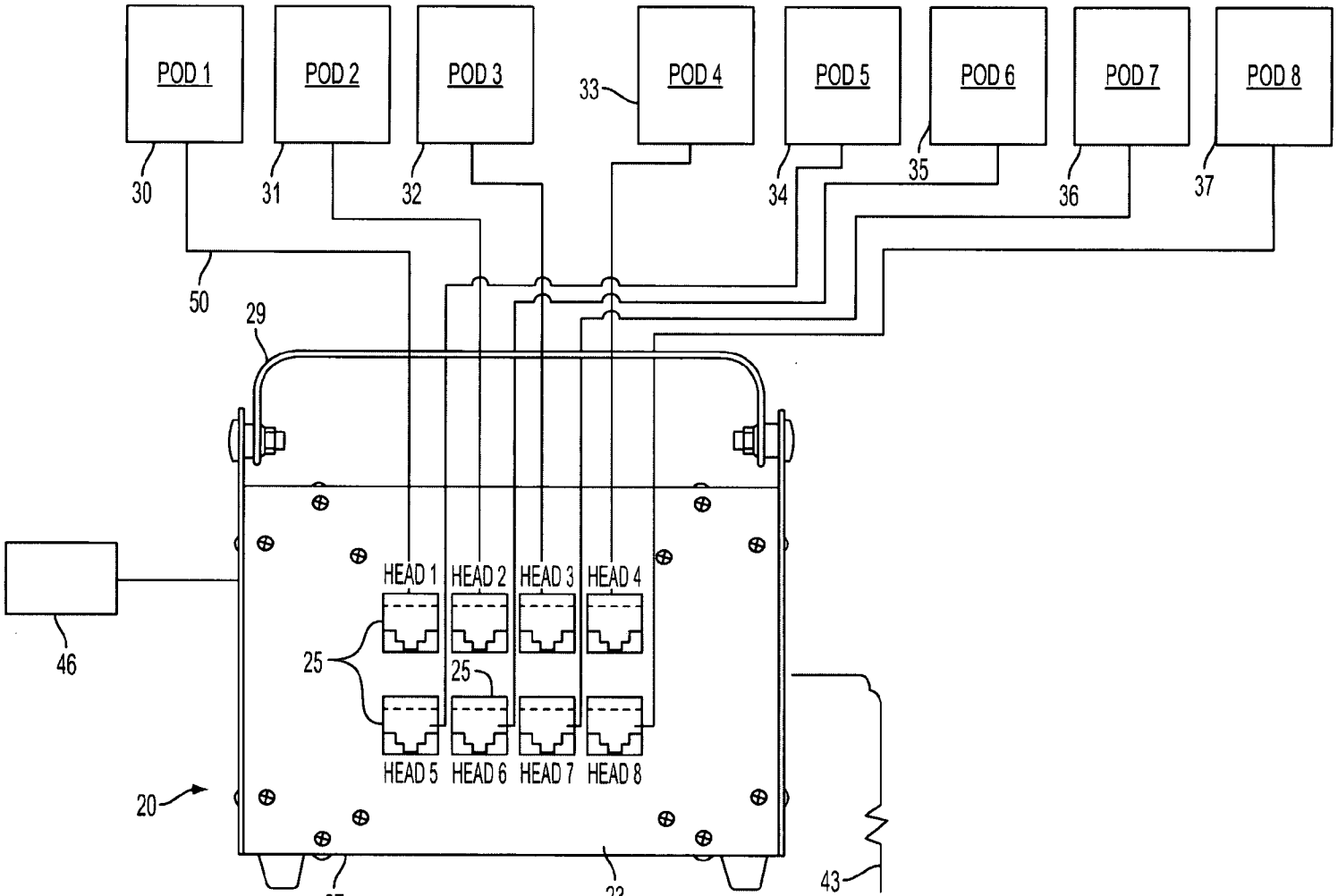
FIG. 1 is a front view of a first embodiment of the invention depicting the laser router in communication with eight laser heads and configured as a master.
Figure 2:
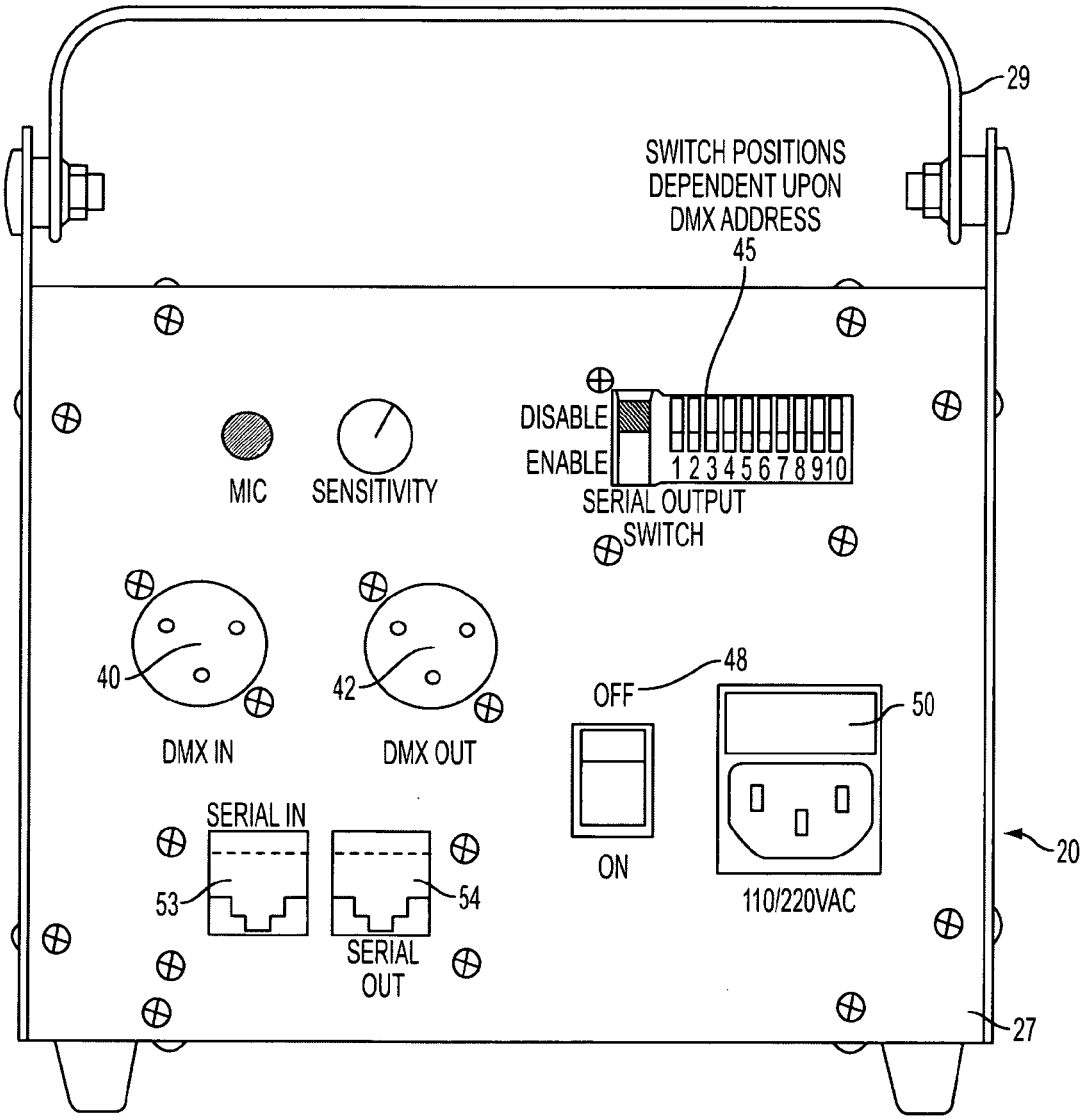
FIG. 2 is a rear view of the router depicted in FIG. 1.

Referring to FIG. 1 router 20 is depicted in communication with laser eight heads 10-18. The front surface 23 of the router includes eight R45 jacks 25 for the reception of cables, such as cable 50, for transmission of activation signals to the laser heads 30-37. Now referring to FIG. 2, the rear of the router 20 also includes R45 jacks 21 and 23 for serial communication with additional router units or a DMX controller. The rear of router 20 also includes an input jack 25 to receive a DMX cable and an output jack 27 for a DMX cable. Router 20 is accordingly DMX enabled and includes a switch 45 to allow the device to be associated with a unique DMX address assigned to the device in a system. In the depicted embodiment, the DMX 512A standard is used to communicate between the router and a central controller 46. DMX512A is a communications protocol commonly used in the entertainment industry and approved by the Entertainment Services and Technology Association. A DMX 512 network will include the controller and one or more devices, such as router 20, each which includes a DMX512 input connector. The DMX controller may also control other devices provided in the network which may be connected with the router in a daisy chain configuration. Referring to FIG. 2, the router 20 is encased by a housing 21 and includes both DMX input port 40 and DMX output port 42. In addition the router include an on of switch 48 and a port for an external power supply 50. A handle 29 is provided to allow for transport and to be used in connection with mounting the device on a support structure. Router 20 may also be operated without a central DMX controller using preprogramed activation sequences.

Figure 3A:
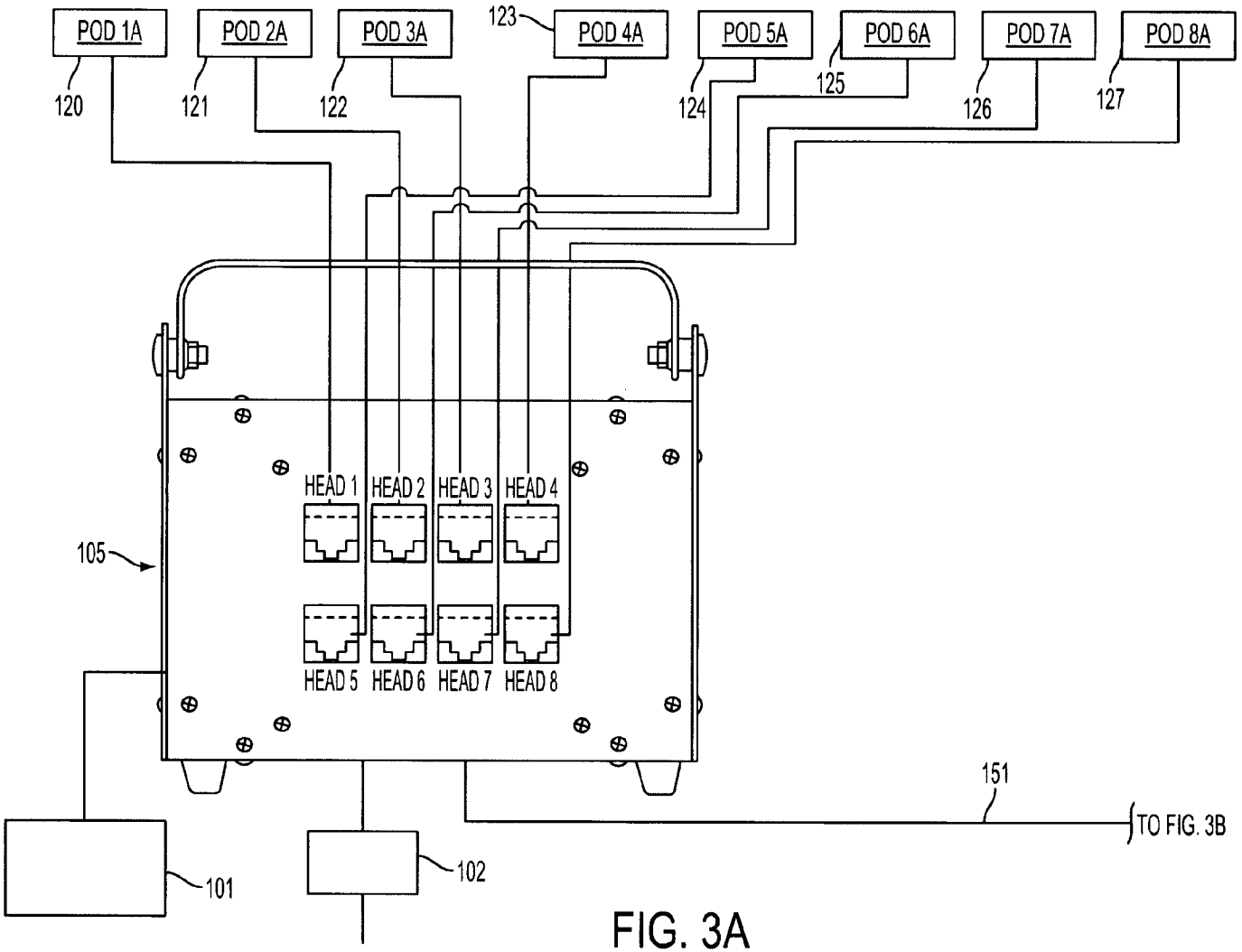
FIG. 3A is a schematic representation of a portion of a further embodiment of the invention in a master slave configuration.
Figure 3B:
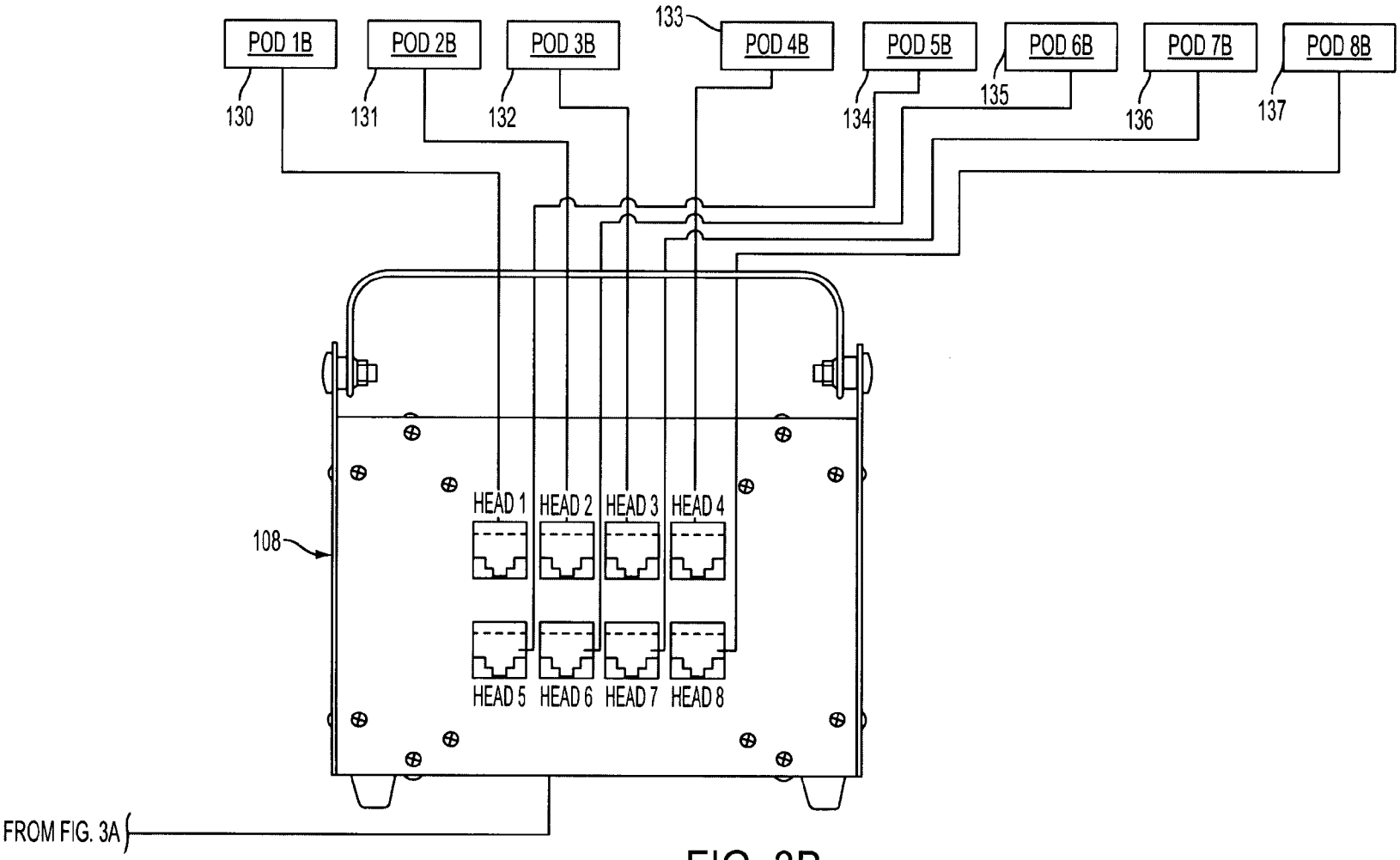
FIG. 3B is a schematic representation of a portion of a further embodiment of the invention in a master slave configuration.

Now referring to FIGS. 3A and 3B router 105 is shown in master configuration and in communication with router 108 which is in slave configuration. Optionally the system may be controlled by DMX control device 101 or the router 105 can provide the control logic. DMX control device 101 may be a control board, a computer or other device than can receive input and then provide output using the DMX512 standard. As shown in FIGS. 3A and 3B, routers 105 and 108 are identical to router 20. The router 105 is in communication and controls eight laser heads 120-127 and router 108 is in communication with laser heads 130-137. Multiple routers can be daisy chained in a master/slave mode or may be independently controlled as nodes in a larger system via the DMX-512A standard. The system depicted in FIGS. 3A and 3B is connected using a cable to a RJ45 jack provided on the rear of the routers. Each router device also includes an input controller that will have a unique DMX address in the system.

The DMX512 communications protocol is compatible with eight pin RJ45 connectors, or more specifically 8P8C connectors, or alternatively, as set forth in the DMX512 1990 specification, the XLR-5 connectors can be used. As best seen in FIG. 2, the router 20 thus includes a network interface controller that can communicate with an external controller by either using the input port 40 or 53. The laser head devices are controlled by the control router using a control signal and a simple relay device.

As discussed above, in a contemplated embodiment, the system is configured to create a "Star Wars" effect. As such, the logic or controller of the router is programmed to sequentially activate each of the heads that are in communication with the router and continually repeat the sequence. Heads may be suspended from the ceiling and arranged at other locations on trusses or other platforms provided throughout a room or event space and are oriented so that the heads emit beams in different directions. The system of the invention has the additional advantage of being able to be easily customized the installation for each location. Unlike the beam table system, the heads may be placed at locations that are not in close proximity and the direction of the beam may be easily aligned to a desired vector by exercising only minimum effort. Further there is no need to use of multiple external mirrors to fill the room as may be required by using a beam table or scanning projector. Thus, in contrast with prior art systems that have been used to achieve the star wars effect, the X-Pod system with its relatively minimalist design and low cost laser heads, can be manufactured inexpensively and be easily setup to achieve the same—and actually an improved—effect.

In an alternative embodiment, the router may receive control signals from external sources such as computers, hand held devices, and other devices that can provide signals over a DMX communications protocol. The router can process such signals and provide corresponding output signals to the laser heads. In yet a further contemplated embodiment, the router and laser heads are in wireless communication.

Figure 4:
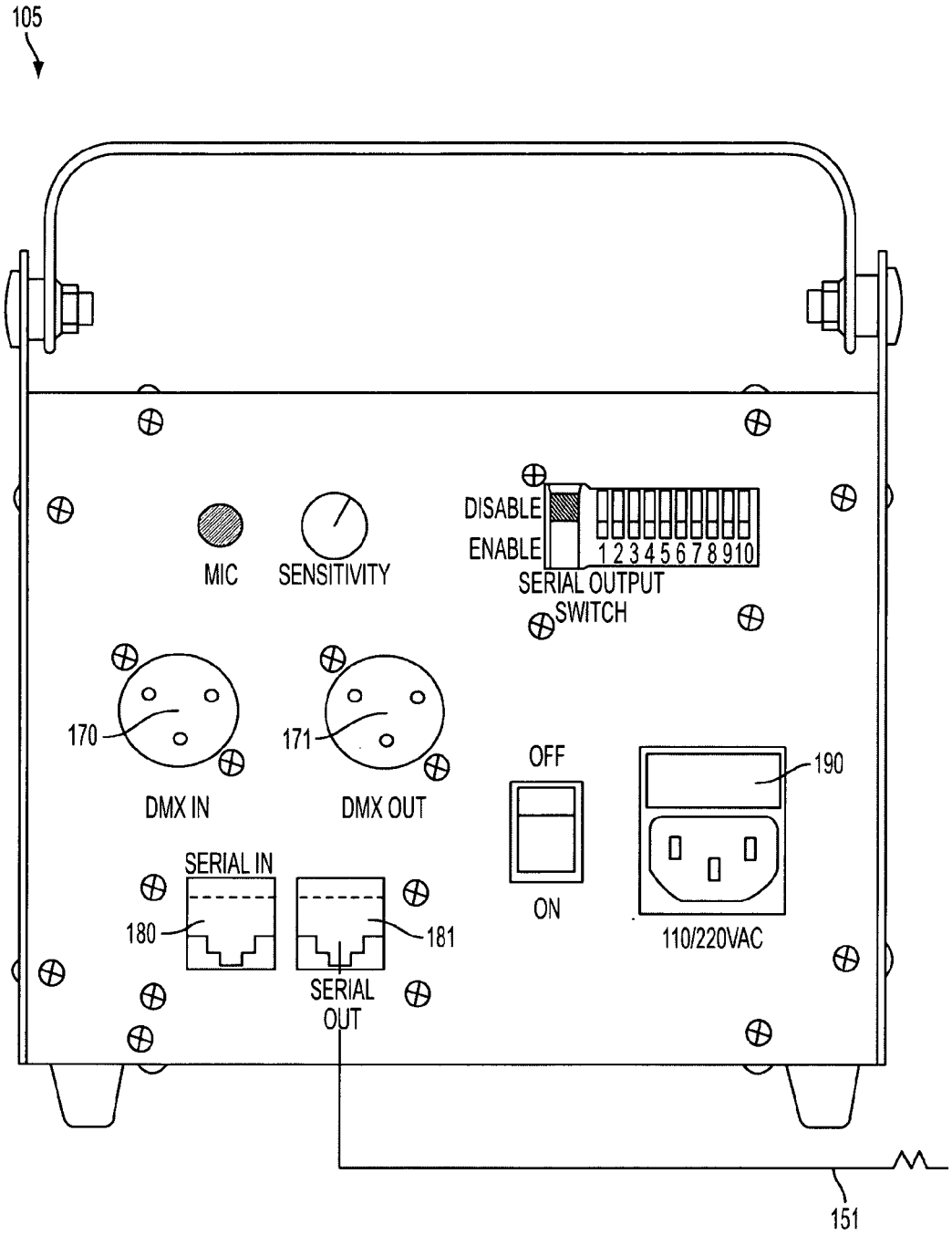
FIG. 4 is a rear view of router 101 in master configuration.
Figure 5:
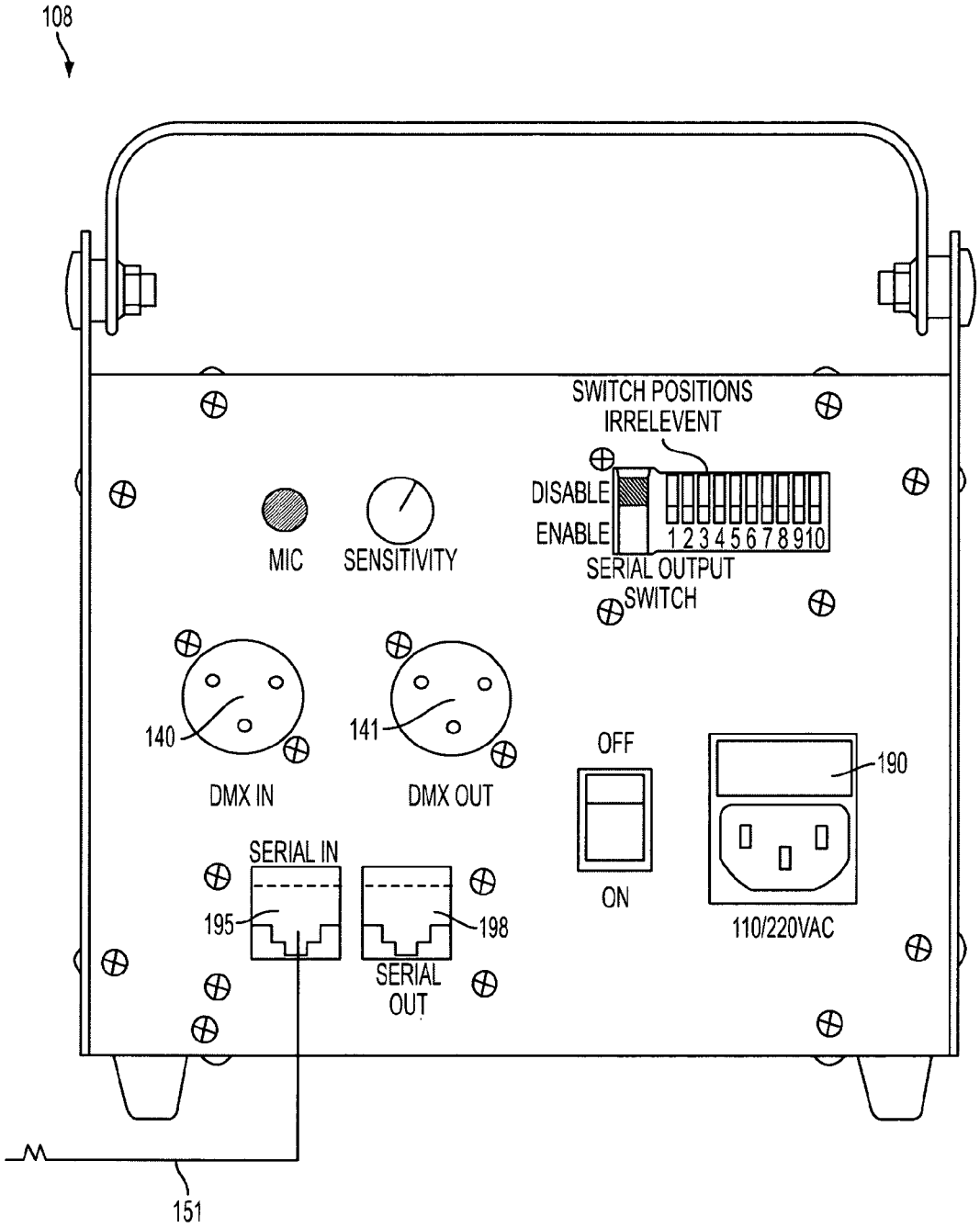
FIG. 5 is a rear view of router 150 in slave configuration.

FIG. 4 is a schematic illustration of the rear of the router 105. Like router 20 it includes a DMX input port 170 and an output port 171. In the master mode, the router is in communication via cable 151 with the slave router 108. The configuration uses the serial RJ45 port 181 for the outbound signal. Referring to FIG. 5, cable 151 is received in inbound serial port 195. Additional routers can be added to the system in a daisy chain fashion using output port 198. The DMX ports 140 and 141 are not by the slave 108 in this configuration. The DMX ports 170 and 171 may be optionally used to control the master router 108 and, include others routers, routers in master configurations or other DMX enabled devices by communication with the output port 171.

Figure 6:
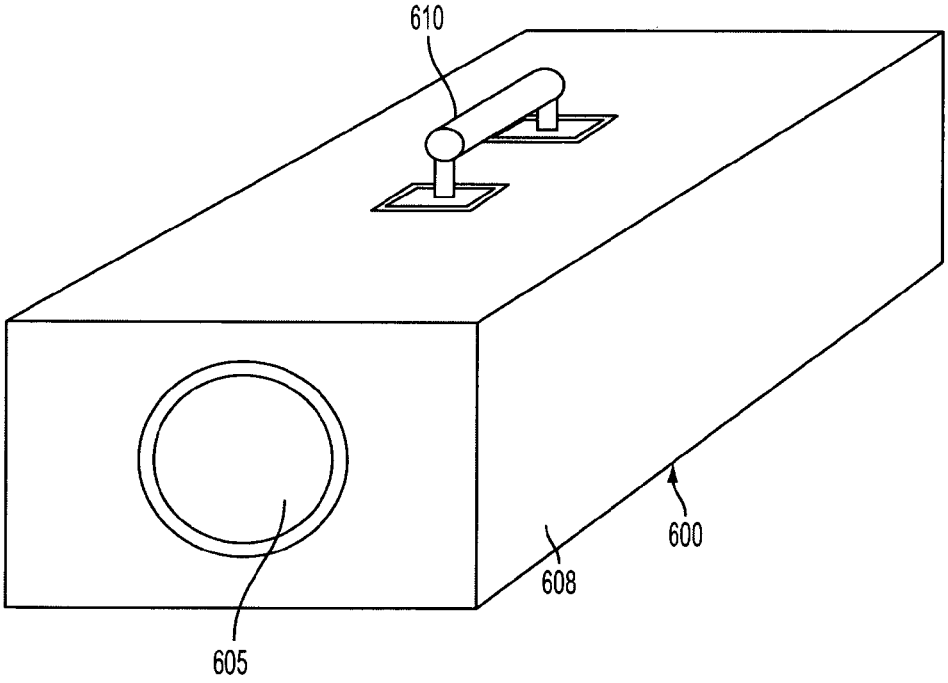
FIG. 6 is a schematic representation of an exemplary laser head.

Now referring to FIG. 6, each laser head 600, contains a laser diode, control circuitry, a fan for cooling, power regulation and an RJ45 jack to accept incoming control signals from the router and power. The router is enclosed by casing 608 in which is provided a window 605 that allows the beam to exit. Each laser head includes a low voltage relay or control circuit which is energized by a signal transmitted over the transmission to the laser head. In the preferred embodiment the relay in the laser head device is a solid state controller. The preferred laser heads for use in the system use a smaller diode than conventional scanning lasers and because they are not scanning, do not require motor actuation. The laser head device as described herein has only one external optical surface 605 per beam that needs to be periodically cleaned. A failure in one laser head would have no impact on the other laser heads in the system whereas a failure of one mirror in the systems described above could easily ruin the effect further down the optical train.

Laser head that may be advantageously used in the system, are commercially sold by under the X-Pod brand by X-Laser of Laurel, Md. These laser heads are smaller than scanner projectors and are designed to fit into small spaces. In an embodiment, the laser head unit has dimensions of 5.25"× 3.25" and is only 3" tall. In a commercial embodiment, the laser head uses a forced air cooling system and the laser is classified as an FDA/IEC Class IIIB. The nominal divergence is 2-5 Rad and the laser source is a DPSS/Direct diode.

The devices may be hung in a fixed position or merely set on a stable platform. All that is required to set the lasers up in the system is to aim the device in the intended direction. While the lasers may be affixed to trusses or other supporting surface, since the operation lacks a motor and there is no vibration created by the device, they may be merely set in position. The laser beam that is created is a relatively thick beam than is directed in a single direction.

The devices may be positioned in a wide variety of configurations to create a variety of effects including rows, a lattice arrangement, chasing or still. They may be positioned in the same plane or terraced and the may be directed at any safe angle. In an embodiment each laser head emits a 50 mW wide and bright green beam that is produced by a DPSS diode laser module. It is configured to receive conventional 24AWG CAT5E cabling for control and power and can be positioned up to 200 feet from the router.

In an embodiment each laser head emits a single static beam which can be modulated rapidly by the incoming control signal from the router. However, the head could also contain stepper motor or galvanometer scanners, diffraction gratings or any one of a number of optics which may change the precise visual effect of the beam. The effect of the plurality of the activation of a plurality of heads, in a controlled and sequenced manner yields a pleasing effect. The heads may derive their power from the router or alternatively, through some other means such as a 120V input at the head location. The laser heads preferably emit red, green or blue light and the colors can be integrated in numerous combinations. The system is easily scalable by using the device in the master/slave mode. The router can control the laser heads in a variety of modes. For example, all the heads can be simultaneously activated, each head can be activated in a chase pattern or any other selected pattern. The heads can be activated to simulate a random pattern. The time in which each head is activated can also be set to a rapid modulation or slower modulation. The activation can also be integrated with DMX programs to synchronize to music.

After programming the router logic includes both sequential programming and random chase pattern programming which, in effect, may sequentially or randomly activate the plurality of heads. In addition, the router has the ability to active one or more of the heads at any speed or with constant power for continuous effect. Each chase sequence can be activated, terminated, or modified (such as the speed of the pattern) by numerous control signals such as audio input through a microphone located in the housing, digital signals conforming to the DMX512-A standard, inputs through integrated serial ports from any device capable of producing a serial signal or the device itself may, upon the application of power, begin pre-programmed patterns and effects. As such alternative embodiments, the router may receive control signals from external sources such as computers, hand held devices, and other devices that can provide signals over a DMX communications protocol. The router controller can process such signals and provide corresponding output signals to the laser heads.

Figure 7:
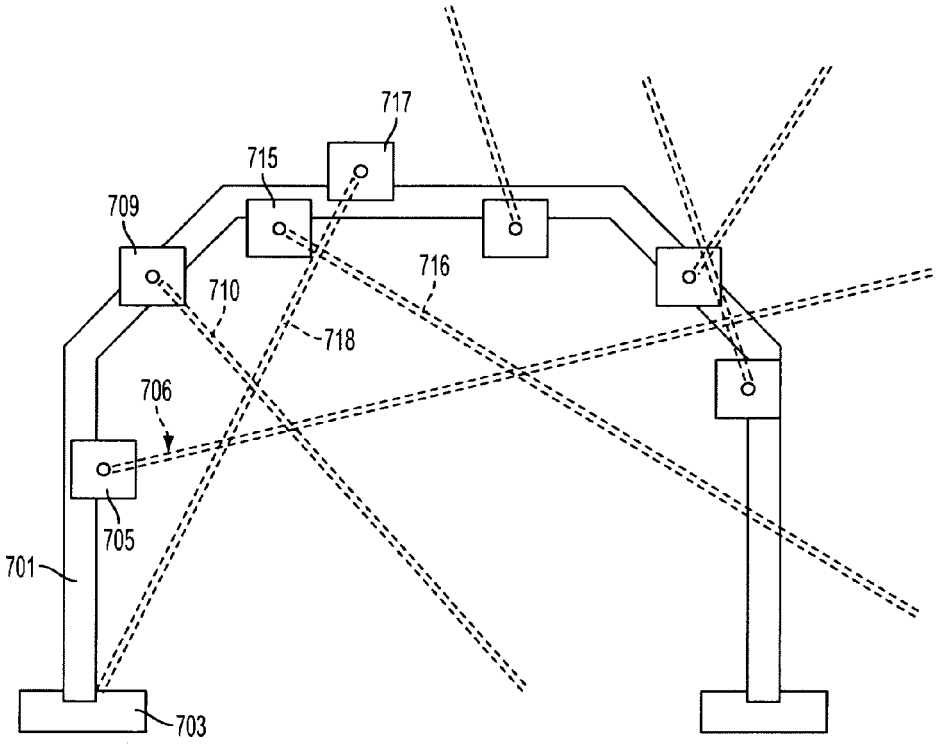
FIG. 7 is an exemplary arrangement of laser heads posited on a support structure.
Figure 8:
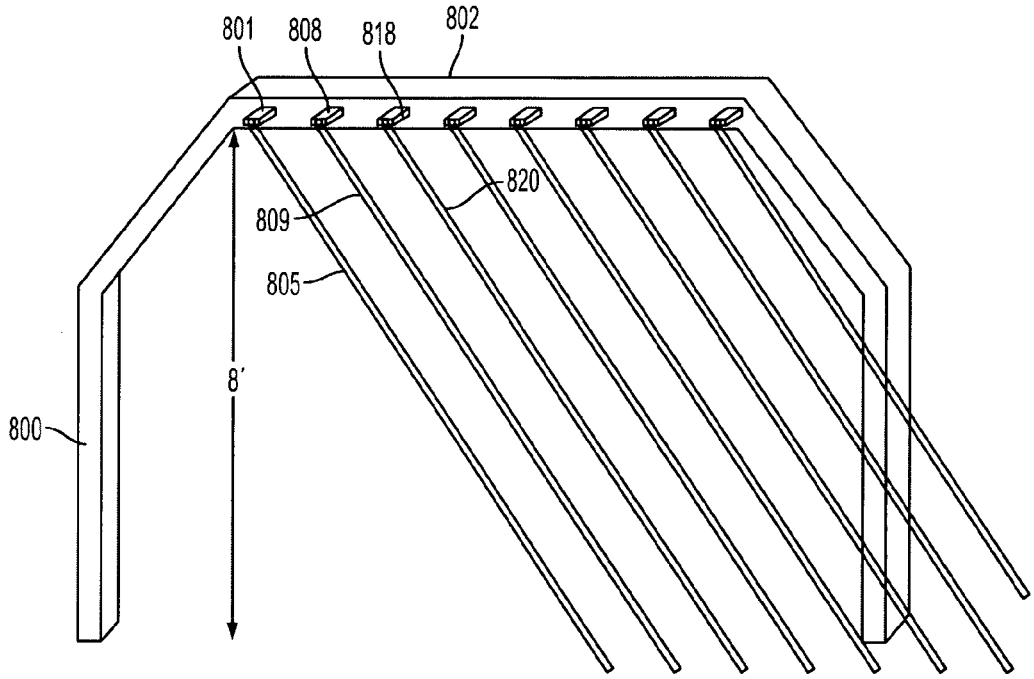
FIG. 8 is an alternative exemplary arrangement of laser heads positioned on a support structure.
Figure 9:
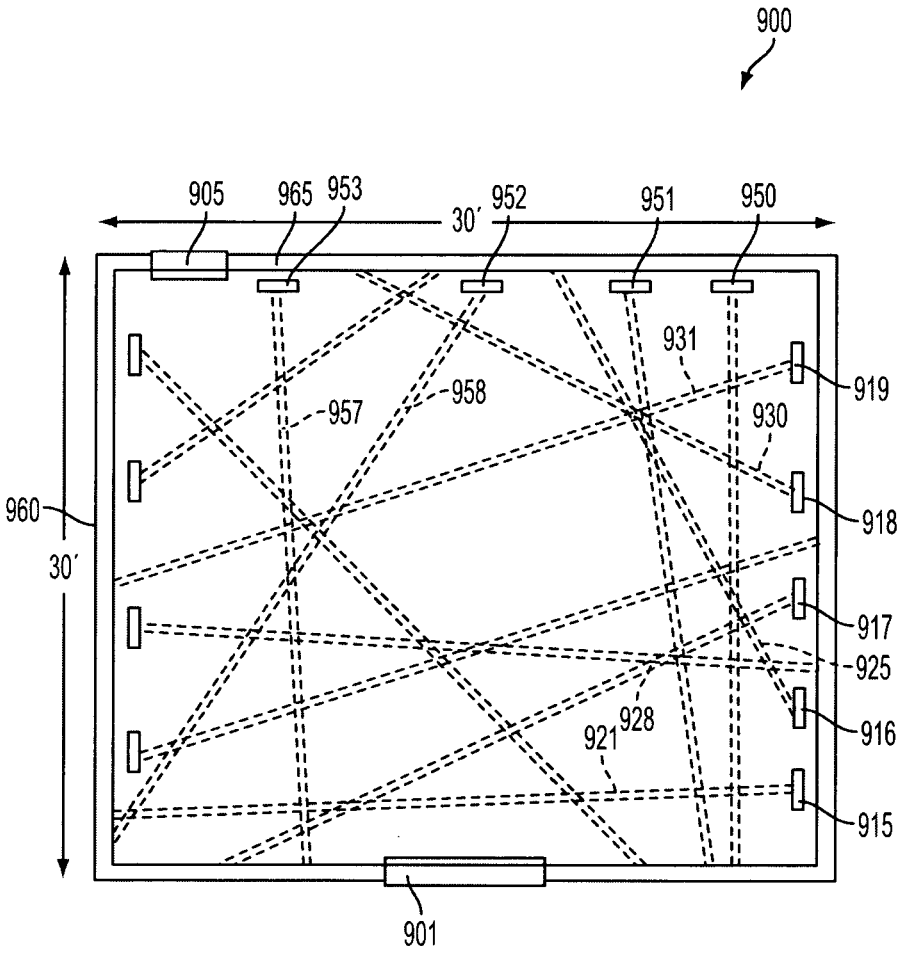
FIG. 9 is a top view of an exemplary arrangement of laser heads in a room.
Figure 10:
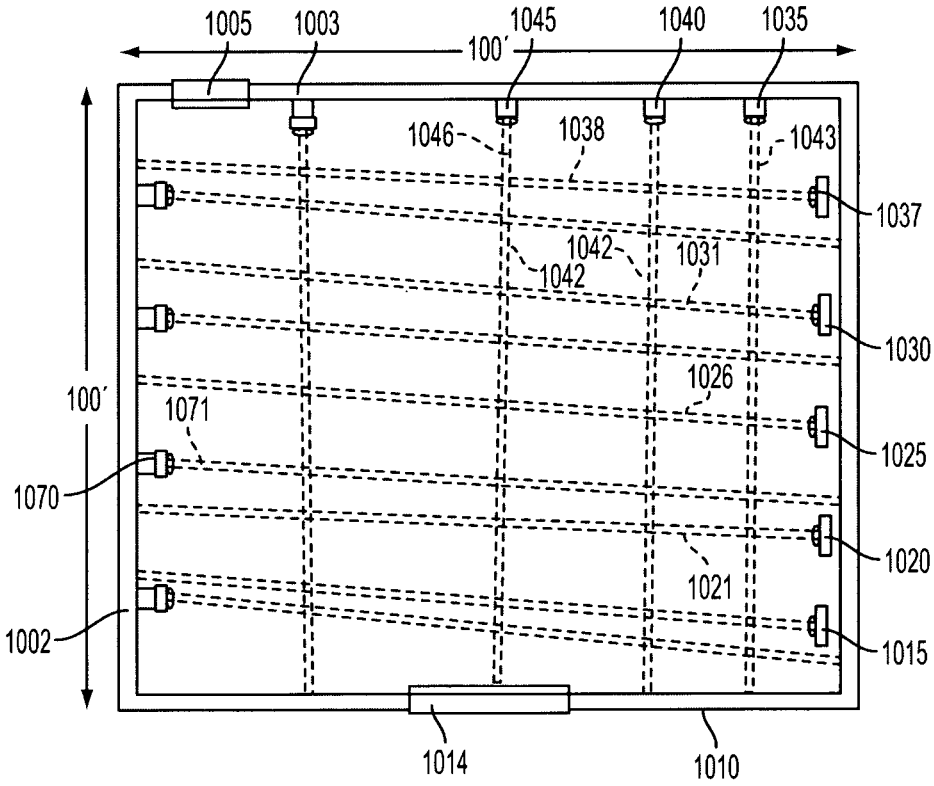
FIG. 10 is a top view of an alternative exemplary arrangement of laser heads in a room.

FIG. 7 depicts an exemplary arrangement of the laser heads including 705 709 715 and 717 on a support member 710. In this arrangement the some of the heads are placed at different heights from the base 703 and each heads is oriented to project a beam in a unique direction. FIG. 8 depicts an alternative arrangement wherein each of the heads 801, 808 and 818 are positioned in the same plane on top support member 802 and the beams 805, 809 and 820 are projected in a parallel arrangement. FIG. 9 depicts a further arrangement of laser heads distributed around the periphery of a room having dimensions of 60 feet by 60 feet. For safety considerations, the laser heads are typically positioned and project beams above eye level. FIG. 10 depicts a top view of another exemplary arrangement of laser heads in a room 1010. The room includes entry ways 1014 and 1005. The first laser heads, 1015. 1020, 1025 1030 project beams in a parallel configuration, while laser heads 1045, 1040 and 1035 project another set of beams 1046, 1043 perpendicular to the first set. Like the room depicted in FIG. 9, the dimensions of the room are 30 feet by 30 feet and the system can easily accommodate this size venue.

In addition to light show entertainment applications the system of the invention has additional applications and uses. For example, the built in serial control port can allow the laser heads to integrate with a factory control system to activate specific pods to trip a light sensor, signal "stop and go" for places where automated processes cross walkways, detect size or shape of objects.

The laser heads can be used as entry control creating a curtain of light over areas where persons should not enter at a particular time making it nearly impossible to accidentally enter a hazardous or restricted area that cannot be easily sealed off in a conventional manner. Alternatively, the heads may be used to identify entrance and exit locations and can be activated at those times when egress is required. The various exit locations can be further identified by a blinking light pattern and by different colored lasers to allow discrimination among those in proximity.

In connection with military or police training the system of the invention can be used in by providing a pre-determined sequence of signals to activate laser heads to provide long distance, highly visible targets. The system can also be used in a similar manner in connection with training for quarterbacks, tennis players, sport shooters and other recreational and instructional purposes.

The system of the invention could also be used, for example, in equestrian sports to digitally score failed jumps without risking the horse running into a physical bar and injuring itself. In a further application the system can be used as a visual representation of musical frequencies for the deaf, for music students and for entertainment purposes. In a contemplated application, 32 laser heads could be provided in a line with each laser head corresponding to one of 32 primary frequency bands in music. Sound from a performance may be run through a simple midi-serial sequencer which then triggers the corresponding head to modulate off precisely in time with the music. The system of the invention may also be used for television and film to approximate laser based security systems or create obstacle courses.

I claim:

1. A laser light display system comprising a plurality of laser heads and a router controller and a plurality of transmission cables, each said laser head devices further comprising a single laser diode, a control signal receiving means, a laser controller and power source, wherein said laser controller comprises a relay, and said a router controller further comprising a plurality of output ports, a programmable logic controller to provide output signals to control the activation of said laser head devices, and wherein said transmission cables are in communication with said router controller and transmit control signals from said router controller to said laser head devices, and wherein said laser heads are enclosed by a casing through which a single window defining an exterior optic surface and said laser emits a single static and motionless beam of radiation of visible light through said window.

2. The system recited in claim 1 wherein the router controller further comprises a DMX input port and said programmable logic controller can be activated by a signal received from said DMX input port.

3. The system recited in claim 1 wherein said laser is classified as a FDA/IEC Class IIIB.

4. The system recited in claim 1 further comprising a second controller router in communication with said first controller router and configured in a slave operating mode and wherein said second controller controls a plurality of laser heads.

5. The system recited in claim 1 wherein said plurality of laser heads emit the substantially the same wavelength of radiation.

6. The system of claim 1 wherein at least three laser heads are positioned at locations more than 3 feet from one another.

7. The system of claim 6 wherein each beam is projected in a vector having a different direction from the other beams.

8. The system of claim 6 wherein each beam is projected in a different plane.

9. The system of claim 6 wherein each laser is sequentially activated and then deactivated at unique time periods.

10. A method of creating a laser light show comprising positioning at least three laser heads at discrete locations on a support structure, wherein said laser heads comprise FDA/IEC Class IIIB devices, and each said laser head further comprises a diode and driver that creates a single static and stationary beam and a controller, said method further comprising orienting said laser heads in three different directions, and then activating a first laser head to project a visible light beam to define a first vector for a first predetermined time, activating a second head to project a visible light beam to define a second vector after said first predetermined time has elapsed for a second predetermined period of time, and after said second predetermined time has lapsed, activating a third laser head to project a visible light beam to define a third vector.

11. The method recited in claim 10 wherein each said vector is oriented in a different direction.

12. The method recited in claim 10 wherein said vectors are in at least two separate planes.

13. The method recited in claim 10 wherein said laser heads are positioned around the periphery of a room and at least one beam is directed toward the center of said room.

* * * * *